US007383707B2

(12) United States Patent
Yamada et al.

(10) Patent No.: US 7,383,707 B2
(45) Date of Patent: Jun. 10, 2008

(54) STORAGE LOCKING APPARATUS

(75) Inventors: Satoshi Yamada, Kanagawa (JP); Toshihiro Shimizu, Kanagawa (JP)

(73) Assignee: Piolax, Inc., Yokohama-shi, Kanagawa-ken (JP)

( * ) Notice: Subject to any disclaimer, the term of this patent is extended or adjusted under 35 U.S.C. 154(b) by 17 days.

(21) Appl. No.: 10/850,556

(22) Filed: May 21, 2004

(65) Prior Publication Data

US 2005/0006906 A1 Jan. 13, 2005

(30) Foreign Application Priority Data

May 23, 2003 (JP) ..... P. 2003-145977

(51) Int. Cl.
*E05B 13/00* (2006.01)

(52) U.S. Cl. ..... 70/208; 70/149; 70/218; 70/472; 292/167; 292/336.3; 292/DIG. 27; 292/DIG. 31; 292/DIG. 63; 296/37.12

(58) Field of Classification Search ..... 70/208, 70/210, 218, 149, 472; 292/DIG. 63, 336.3, 292/DIG. 31, 167, 173, DIG. 11, DIG. 27; 296/24.34, 37.8, 37.12
See application file for complete search history.

(56) References Cited

U.S. PATENT DOCUMENTS 1,346,566 A * 7/1920 Stamm ..... 292/128
2,055,688 A * 9/1936 Halinka ..... 292/153
2,201,444 A * 5/1940 Marsh ..... 292/165
3,596,955 A * 8/1971 Colell ..... 292/336.3
4,534,193 A * 8/1985 Takemura et al. ..... 70/218
4,580,821 A * 4/1986 Genord et al. ..... 292/336.3
4,867,501 A * 9/1989 Nomura et al. ..... 296/146.9
5,263,346 A * 11/1993 Sato et al. ..... 70/210
5,292,159 A * 3/1994 Sandhu et al. ..... 292/173
5,484,178 A * 1/1996 Sandhu et al. ..... 292/173
6,722,718 B2 * 4/2004 Brown et al. ..... 296/37.12
2002/0171248 A1 * 11/2002 Diss et al. ..... 292/164

FOREIGN PATENT DOCUMENTS

JP 2000-272429 10/2000

* cited by examiner

*Primary Examiner*—Lloyd A. Gall
(74) *Attorney, Agent, or Firm*—McGinn IP Law Group, PLLC

(57) ABSTRACT

An storage locking apparatus including a case attached to an end edge of the storage, a locking member slidably supported by the case for engaging with and disengaging from the supporting member, a first urging member for always urging the locking member in a direction of the supporting member, an operating handle pivotably supported axially by the case for unlocking the storage by being pivoted from a side of the supporting member to a side of the storage, and lever mechanisms for sliding the locking member against the first urging member by pivoting the operating handle in which the supporting member dispenses with a containing portion in a recessed shape as in a prior art by providing an operating space between the supporting member and the operating handle.

19 Claims, 13 Drawing Sheets

STORAGE LOCKING APPARATUS

BACKGROUND OF THE INVENTION

1. Field of the Invention

The present invention relates to an improvement in an storage locking apparatus such as, for example, glove box openably and closably attached to an instrument panel of an automobile.

2. Description of the Related Art

A locking apparatus of this kind of a prior art is constructed by a constitution in which whereas a central portion of a glove box door is integrally formed with a containing portion in a recessed shape, a locking member engaging with and disengaging from a striker provided on a side of an instrument panel is liftably supported at inside of the containing portion in the recessed shape and the locking member is elastically urged to an upper side by urging spring pressure, an operating handle is pivotably supported axially by two side walls of the containing portion in the recessed shape and a front end side of the operating handle is continuously provided with an engaging arm for engaging with an engaging portion of the locking member (refer to JP-A-2000-272429).

Further, in actual use thereof, when the glove box is disposed at a closed position, the locking member is moved up by the urging spring pressure and a front end portion of the locking member is engaged with the striker and therefore, thereby, the glove box is locked to the closed position, on the contrary, in the case of unlocking the glove box, when the operating handle is operated to pivot from a lower side to an upper side by putting the finger into a large operating space partitioned at a lower portion of the containing portion, at this occasion, the engaging arm of the operating handle is engaged with the engaging portion of the locking member to move down the locking member against the urging spring pressure and therefore, thereby, a state of engaging the locking member and the striker is released and the glove box is permitted to move in an opening direction.

Therefore, although the locking apparatus of the prior art achieves at least an advantage of capable of simply locking and unlocking the glove box, the operating space of putting the finger between the operating handle and the glove door needs to partition in view of a relationship of pivoting the operating handle from the lower side to the upper side and therefore, the glove door is integrally formed with the containing portion in the recessed shape, however, since the containing portion is significantly projected to an inner side of the glove box, there is a concern of constituting a hindrance in putting small articles into and from the glove box, or restricting an effective space of the glove box.

SUMMARY OF THE INVENTION

The invention has been developed in order to effectively resolve the problem incorporated in the locking apparatus of the prior art and the invention described in a first aspect adopts a constitution of an storage locking apparatus for locking a door of a storage openably and closably attached to a supporting member, to the supporting member in a closed state, and unlocking the door in an opened state, the apparatus including a case attached to an end edge of the door, a locking member slidably supported by the case for engaging with and disengaging from the supporting member, a first urging member for always urging the locking member in a direction of the supporting member, an operating handle for unlocking the door; and a lever mechanism for sliding the locking member against the first urging member by pivoting the operating handle, an operating space disposed between the supporting member and the operating handle, wherein the operating handle is pivotably supported by the case at a portion that is far from the end edge, the operating handle is pivoted from a side of the supporting member to a side of the door, when the door is unlocked, and the operating space is formed by hollowing a portion of the supporting member which corresponds to the operation handle.

The invention described in a second aspect adopts a constitution in which the lever mechanism includes a link member and a lever member and respectives thereof are pivotably supported axially by the case and capable of switching the link member and the lever member between a sliding contact state and a non sliding contact state on the premise of the first aspect.

The invention described in a third aspect adopts a constitution further including a second urging member for urging a front end portion of the link member to a side of always urging the locking member on the premise of the second aspect.

The invention described in a fourth aspect adopts a constitution in which the locking member includes an engaging portion brought into sliding contact with the lever member and includes a three members sliding contact portion interposed between the front end portion of the link member and the engaging portion to be brought into sliding contact therewith on the premise of the second aspect or the third aspect.

The invention described in a fifth aspect adopts a constitution in which a key cylinder lock having an eccentric shaft for switching the sliding contact state and the nonsliding contact state and the lever member is connected to the eccentric shaft between an axially supported position thereof and the three members sliding contact portion on the premise of the second aspect through the fourth aspect.

The invention described in a sixth aspect adopts a constitution in which the operating handle includes an operating claw between an axially supported position thereof and a side portion and the link member includes a connecting hole for engaging with the operating claw on a side opposed to the three members sliding contact portion by interposing an axially supported position thereof on the premise of the second aspect through the fifth aspect.

Therefore, according to the invention described in the first aspect, in view of a relationship in which the operating handle pivoted from an upper side to a lower side is axially supported by an upper end edge of the storage and a portion of the supporting member in correspondence with the operating handle is partitioned with the operating space for inserting the finger, a portion unnecessarily projected to an inner side of the storage as in the prior art is dispensed with and therefore, there is not a concern of constituting a hindrance in inputting in and out small articles and an inner space of the storage can effectively be utilized.

According to the invention described in the second aspect, in view of a relationship in which the link member and the lever member constituting the lever mechanism are switched between the sliding contact state and the nonsliding contact state, the invention can be applied to embody for a locking apparatus having a key cylinder and for a locking apparatus which is not provided with a key cylinder and therefore, the invention becomes significantly rational. According to the invention described in the third aspect, in view of a relationship in which the second urging member for urging the front end portion of the link member is provided to the side of always urging the front end portion of the link member, rattling of the operating handle can effectively be prevented. According to the invention described in the fourth aspect, in view of a relationship in which the front end portion of the link member, the front end portion of the lever member and the engaging portion of the locking member are arranged successively from an upper side, the apparatus per se can be downsized by thinning the sliding contact portion of the three members.

According to the invention described in the fifth aspect, in view of a relationship in which the lever member is connected to the eccentric shaft of the key cylinder lock between an axially supported position thereof and the three member sliding contact portion, the invention serves also as a guide in pivoting the lever member and therefore, smooth operation can be guaranteed. According to the invention described in the sixth aspect, in view of a relationship in which the operating claw present between an axially supported position of the operating handle and a side portion thereof is engaged with the connecting hole present on the side opposed to the three members sliding contact portion by interposing the axially supported position of the link member, an angle of operating the operating handle becomes obtuse, an amount of moving the locking member is reduced, a distance between the locking claw and the locking member can be increased and therefore, also an operating force is reduced.

BRIEF DESCRIPTION OF THE DRAWINGS

These and other objects and advantages of this invention will become more fully apparent from the following detailed description taken with the accompanying drawings in which:

FIG. 13 is a perspective view of an essential portion showing a relationship between an instrument panel and a glove box or the like.

DETAILED DESCRIPTION OF THE PREFERRED EMBODIMENTS

Figure 13:
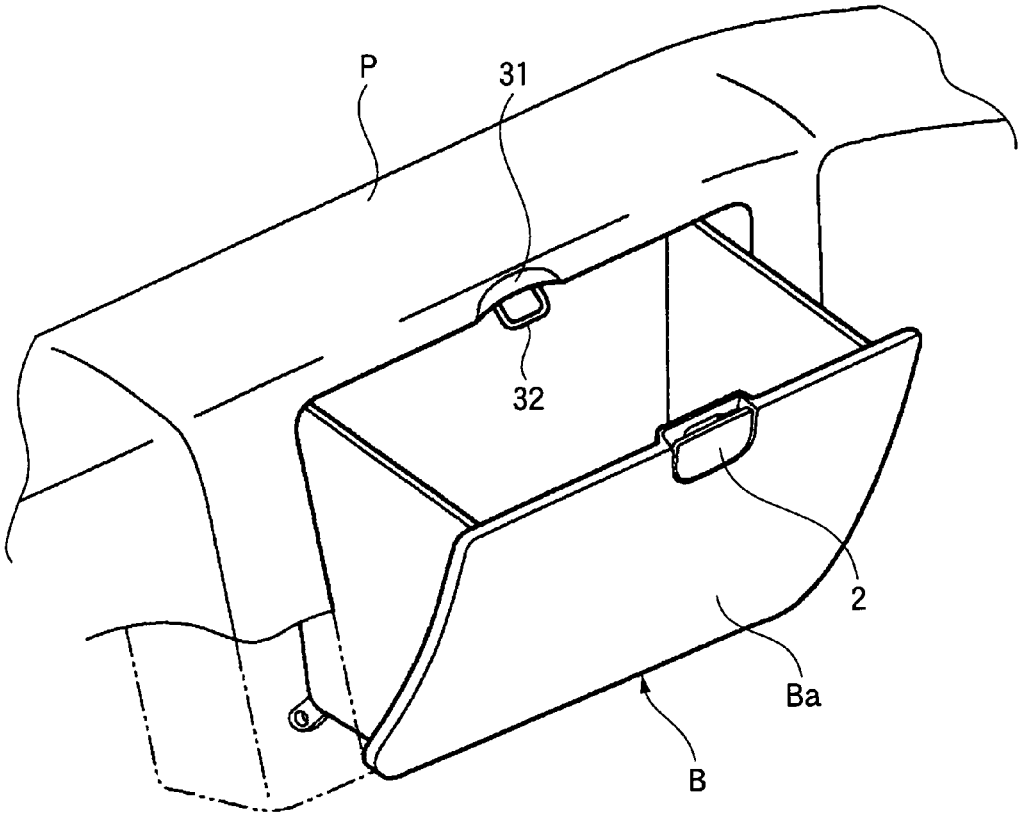

When a detailed description is given of the invention based on an illustrated preferable embodiment as follows, as shown by FIG. 13, similar to the prior art, also a locking apparatus according to the embodiment has been developed with an object of a glove box B openably and closably attached to an instrument panel P of an automobile, the embodiment is characterized in that an upper end edge of a glove door Ba of the glove box B constituting a storage is provided with an operating handle 2 pivoted from an upper side to a lower side, a portion of the instrument panel P constituting a supporting member is partitioned with an operating space 31 for inserting the finger and the glove box B can be unlocked by operating to pivot the operating handle 2 from the upper side to the lower side by utilizing the operating space 31. Therefore, it is not necessary to provide the operating space 31 for inserting the finger on a side of the glove box B, a portion of the glove box B projected to an inner side can be dispensed with and therefore, a hindrance in putting small articles into and from the glove box B can be eliminated. Further, a dead space at inside of the glove box B which has been produced by presence of a projected portion can also be dispensed with.

Figure 1:
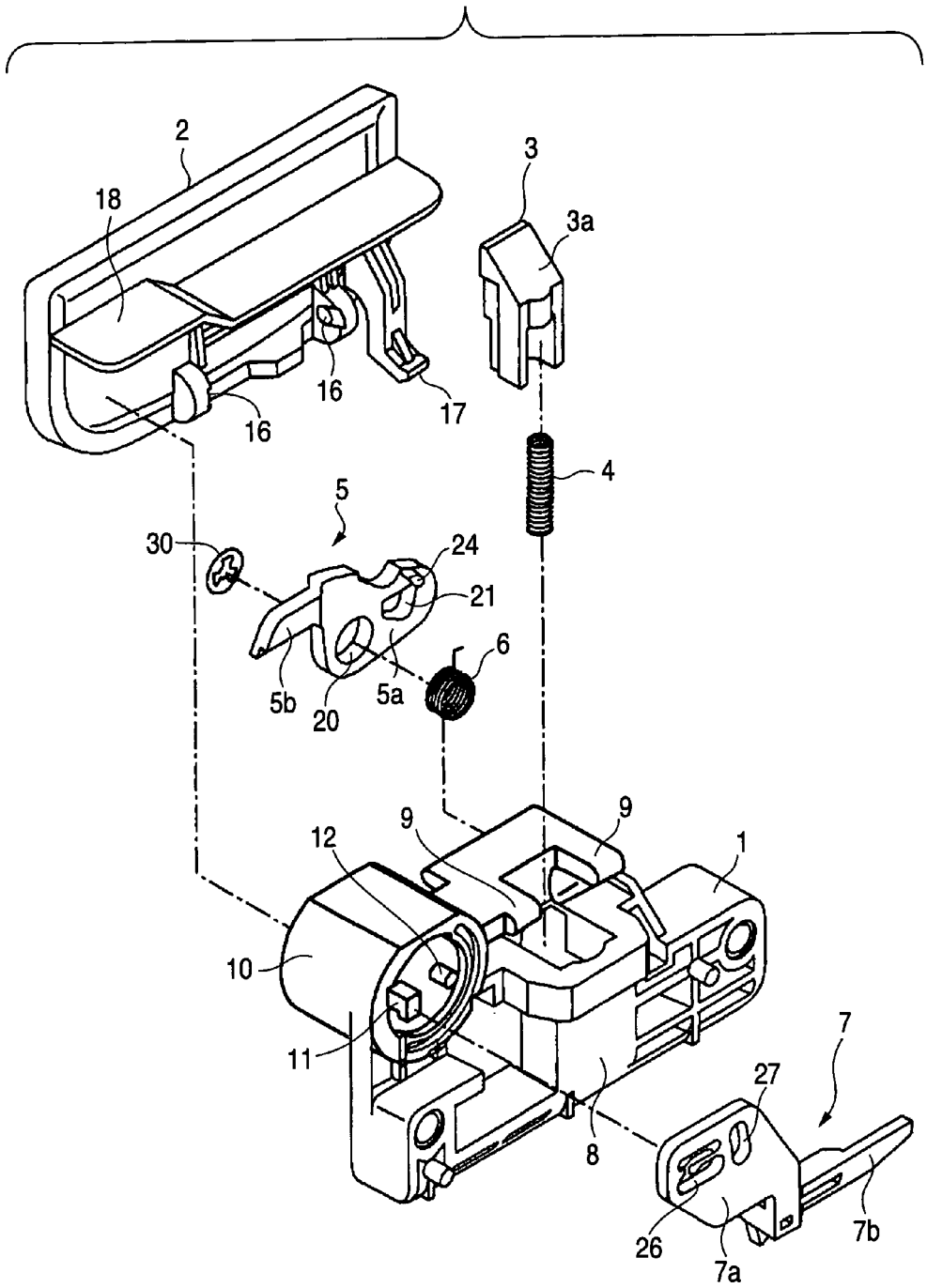
FIG. 1 is a disassembled perspective view showing a locking apparatus according to an embodiment of the invention from a rear side thereof.

Hence, when a specific explanation is given thereto, as shown by FIG. 1, the locking apparatus according to the embodiment is constructed by a constitution including a case 1 screwed to a central portion of the upper end edge on the side of the glove door Ba shown in FIG. 13 from a rear side thereof, the operating handle 2 axially supported by the case 1 to pivot from an upper side to a lower side, a locking member 3 for engaging with and disengaging from a striker 32 (refer to FIG. 13) liftably supported by the case 1 and provided on the side of the instrument panel P, a compression coil spring 4 constituting a first urging member for urging the locking member 3 in a direction of engaging with the striker 32, a link member 5 axially supported pivotably by the case 1 and pivoted by operating to pivot the operating handle 2, a torsional coil member 6 constituting a second urging member for urging a front end portion 5*b* of the link member 5 to an upper side of the case 1, and a lever member 7 axially supported pivotably by the case 1 for moving down the locking member 3 in accordance with pivoting of the front end portion 5*b* of the link member 5 against urging spring pressure of the compression coil spring 4. Further, a lever mechanism connecting the operating handle 2 and the locking member 3 is constituted by the lever member 7 and the link member 5.

Further, there is constituted a three members sliding contact portion for transmitting a force from the operating handle 2 to the lever member 7 and the locking member 3 by way of the link member 5 by bringing an upper face of a front edge portion 7*b* of the lever member 7 and the front end portion 5*b* of the link member 5 into sliding contact with each other and bringing a lower face of the front end portion 7*b* of the lever member 7 and an upper face of an engaging portion 19 (refer to FIGS. 3A and 3B) of the locking member 3 into sliding contact with each other. According to the three members sliding contact portion, the force from the operating handle 2 can simultaneously be transmitted to the lever member 7 and the locking member 3 at one location. A magnitude of a transmittable force is proportional to an area of a portion with which each member is brought into sliding contact and therefore, an area to some degree is needed. By constructing the constitution of bringing the link member 5 and the lever member 7 and the engaging portion 19 of the locking member 3 into sliding contact with each other in a laminated state thereof, the two sliding contact portions can be integrated to the one location and therefore, the apparatus per se can be downsized and also maintenance thereof is facilitated.

Figure 2A:
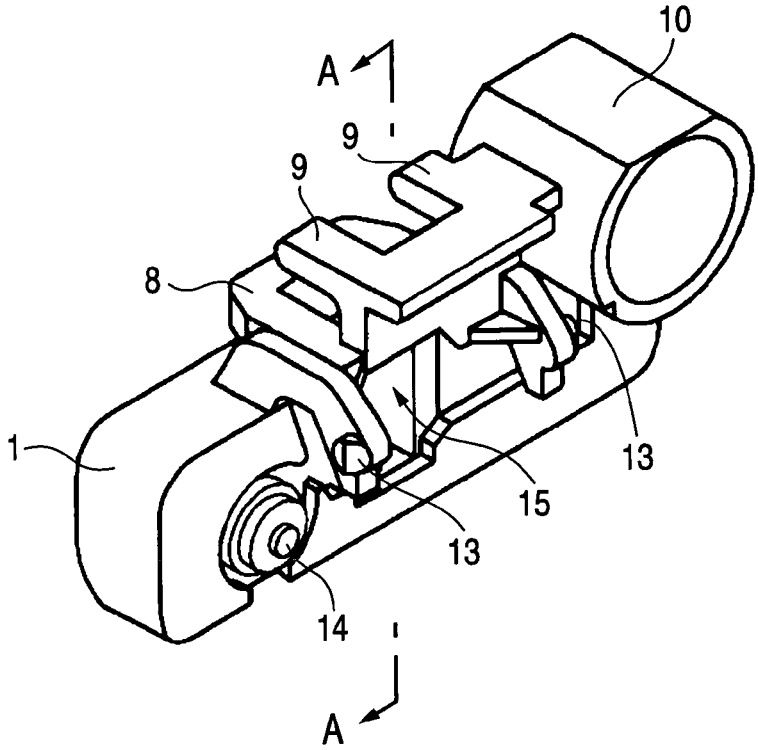
FIG. 2A is a perspective view showing a case from a surface side and FIG. 2B is a sectional view taken along a line A-A of FIG. 2A.
Figure 2B:
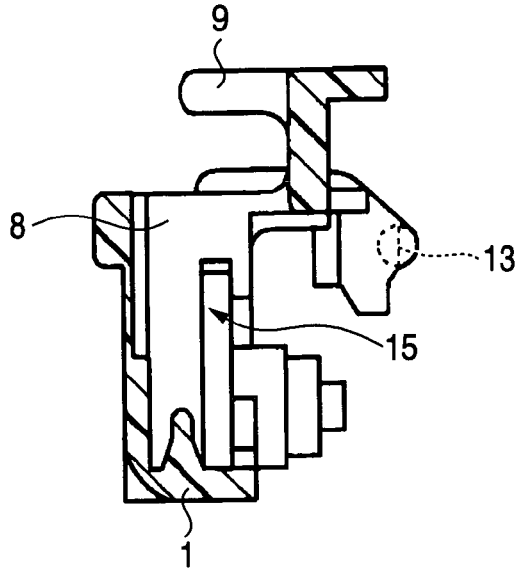

Further, also as shown by FIGS. 2A and 2B, the case 1 is constructed by a constitution in which whereas a central portion thereof is formed with a containing chamber 8 for supporting the locking member 3 and the compression coil spring 4, and an upper portion of the containing chamber 8 is formed with a pair of receiving walls 9 constituting a horizontal U-like shape for receiving the striker 32, a side portion of the receiving wall 9 is integrally and continuously provided with a cylindrical wall 10 having a structure of capable of mounting a key cylinder lock at inside thereof, a side of a rear face of a bottom portion of the cylindrical wall 10 is formed with a first shaft 11 constituting a fulcrum of pivotal movement of the lever member 7 and a second shaft 12 for guiding the pivotal movement, both sides on a side of a surface of the containing chamber 8 are formed with a pair of shaft portions 13 fitted to respective bearing portions 16 of the operating handle 2, mentioned later, further, a lower portion of a surface of an opposed side of the cylindrical wall 10 is formed with a third shaft 14 constituting a fulcrum of pivotal movement of the link member 5. Further, the engaging portion 19 of the locking member 3, mentioned later, is made to be able to move by opening an entire region of the side of the surface of the containing chamber 8 and utilizing an opening port 15 thereof.

Further, the case 1 is provided with the operating handle 2 on a surface side thereof and fixed to the glove door Ba on a rear side thereof and the locking member 3 is put into and from an upper side thereof. The containing chamber 8 is constituted by a bottomed hole in a square shape opened from the upper side to a lower side of the case 1 and is provided with a guide groove in an up and down direction for constituting a guide when the locking member 3 is slidingly moved in the up and down direction and a bottom portion thereof includes a face supporting one end of the compression coil spring 4 and a projection inserted to an inner side of the compression coil spring 4 to constitute a guide in expanding and contracting the compression coil spring 4. The receiving walls 9 are constructed by a constitution constituting the horizontal U-like shape and having an opening in a horizontal direction for receiving the locking member 3 from a lower side to close the opening and forming a space in cooperation with the receiving walls 9 and the locking member 3.

The cylindrical wall 10 is formed from the surface side to the rear side of the case 1 and includes a recess portion having a dimension and a shape substantially the same as those of an outer configuration of a key cylinder 34, mentioned later, on an inner side thereof. A bottom face of the recess portion is disposed on the rear side of the case 1, the first shaft 11 and the second shaft 12 projected from the bottom face of the recess portion to the rear side of the case 1 in an axis line direction of the cylindrical wall 10 are aligned substantially horizontally with an interval therebetween, a front end of the first shaft 11 constitutes an L-like shape to thereby prevent the lever member 7 from being detached after having been mounted and the second shaft 12 is a projection in a cylindrical shape shorter than the first shaft 11 and constitutes a dimension and a shape substantially the same as those of an eccentric shaft 35 of the key cylinder 34, mentioned later. The two shaft portions 13 are disposed on the surface side of the case 1 and aligned substantially horizontally with an interval therebetween by interposing a center shaft of sliding movement of the locking member.

The third shaft 14 is disposed on the surface side of the case 1 and on a side opposed to the cylindrical wall 10 by interposing the center axis of sliding movement of the locking member 3 and a center of the third shaft 14 and the three members sliding contact portion and a center of the bottom face of the recess portion of the cylindrical wall 10 are aligned substantially on one line. There is a cylindrical portion wound with the torsional coil spring 6 between the third shaft 14 and the case 1 and the cylindrical portion is concentric with the third shaft 14 and an outer configuration thereof is larger than the third shaft 14. There is a ring-like groove at a root of the cylindrical portion for containing a portion of the wound torsional coil spring 6. The groove is provided with a notched portion constituted by notching a portion of an outer wall thereof for catching one end of the torsional coil spring 6.

Further, the above-described containing chamber 8 includes the opening port 15 on the surface side of the case 1 at a lower portion thereof and there is an opening penetrated from the surface side to the rear side of the case 1 between the containing chamber 8 and the cylindrical wall 10, the lever member 7 is arranged by passing the opening and therefore, one end of the lever member 7 is present on the surface side of the case 1 and other end thereof is present on the rear side of the case 1.

The operating handle 2 is constructed by a constitution of forming the pair of bearing portions 16 for fitting the above-described shaft portions 13 on a side of a lower portion of a rear face thereof, forming an operating claw 17 engaged with a connecting hole 21 of the link member 5, mentioned later, in a state of being projected in a direction of the rear face at one end portion thereof and forming a safety plate 18 continuously along a width region thereof at an upper portion of the rear face. Further, the operating handle 2 includes the rear face opposed to the case 1 and a surface constituting a design face, covers the two shaft portions 13 and an opening of a recess portion an inner side of the cylindrical wall 10 and is extended to exceed an upper face of the case 1. The pair of bearing portions 16 are projected at a lower portion of the operating handle 2 at positions of fitting to the two shaft portions 13. The operating claw 17 is projected between the pair of bearing portions 16 and a side portion of the operating handle 2 constituting a contour of the design face, a front end thereof constitutes a hook-like shape, a front end of the hook-like shape is extended to the side of the case 1 by exceeding the bearing portion 16 and extended also to a lower side of the case 1 by exceeding the bearing portion 16. Further, a fillet is provided to an inner side of the hook-like portion of the front end of the operating claw 17 and therefore, when the operating claw 17 is slid by being engaged with a hole edge of the connecting hole 21 of the link member 5, mentioned later, the sliding operation can smoothly be carried out.

Further, there is provided a projected streak for catching the finger by an operator between an upper side portion of the operating handle 2 for constituting the contour of the design face and the safety plate 18. Therefore, the caught finger of the operator is not slipped to detach owing to the projected streak provided along an upper edge of the rear face of the operating handle 2. The safety plate 18 covers an upper portion of the locking apparatus and therefore, even when the operator hangs the finger thereon, the finger is not brought into contact with other portion of the locking apparatus by moving beyond the safety plate 18. Further, the safety plate 18 can prevent a foreign matter or the like from invading from the upper face of the locking apparatus by the gravitational force and prevent a foreign matter adhered to the finger from invading the locking apparatus.

Figure 3A:
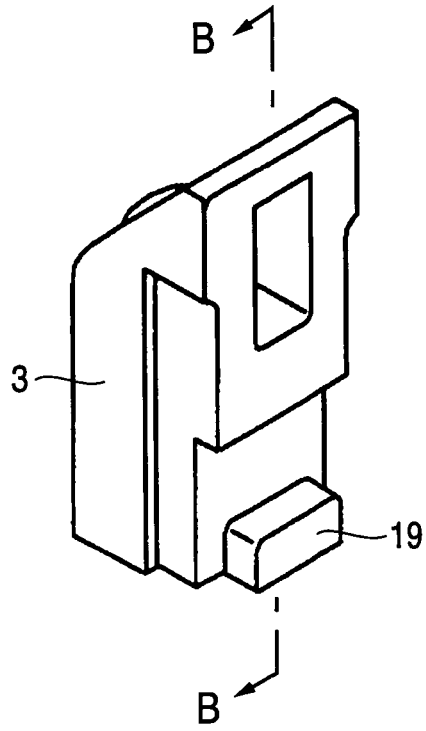
FIG. 3A is a perspective view showing a locking member from a surface side and FIG. 3B is a sectional view taken along a line B-B of FIG. 3A.
Figure 3B:
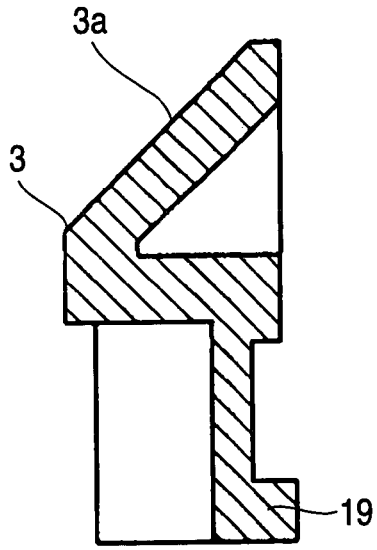

Also as shown by FIGS. 3A and 3B, as described above, the locking member 3 is urged in a direction of being engaged with the striker 32 by an urging spring pressure of the compression coil spring 4 and is constructed by a constitution of being integrally formed with the engaging portion 19 facing an outer side from the opening port 15 of the containing chamber 8 at the lower portion on the side of a surface thereof and pivoting the link member 5 by operating to pivot the operating handle 2 to press the engaging portion 19 by the front end portion 7*b* of the lever member 7 to thereby move down the locking member 3 to release from being engaged with the striker 32. Further, the locking member 3 constitutes a columnar shape having a sectional shape substantially the same as the shape of the hole of the containing chamber 8 on the side of the case 1, is formed with an inclined fact at an upper end in a longitudinal direction thereof, formed with the engaging portion 19 at the lower end and is provided with the projection for fitting to the guide groove of the containing chamber in the longitudinal direction.

Figure 4A:
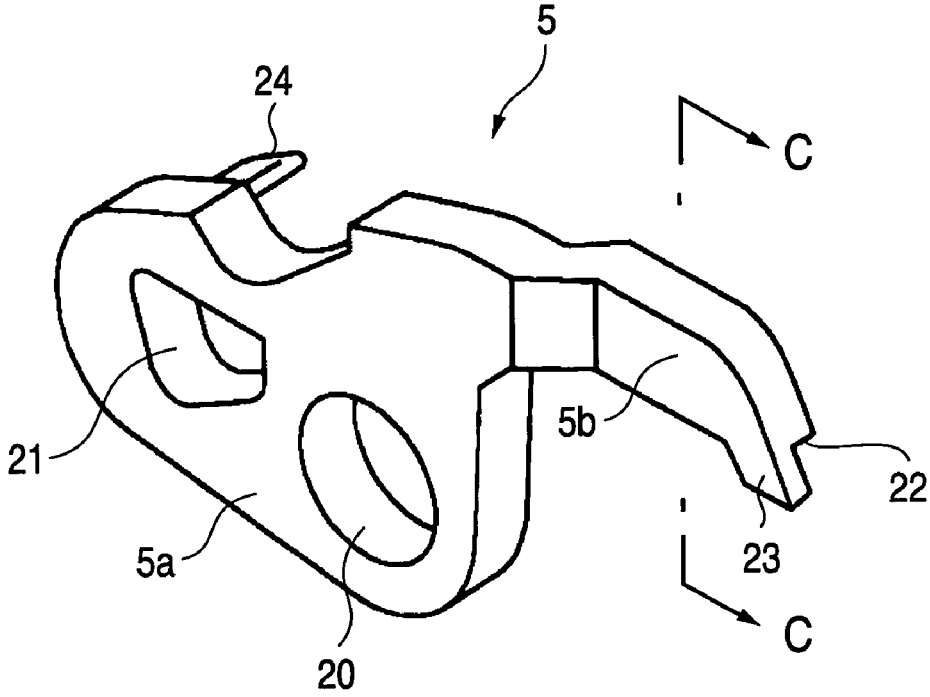
FIG. 4A is a perspective view showing a link member from a surface side and FIG. 4B is a sectional view taken along a line C-C of FIG. 4A.
Figure 4B:
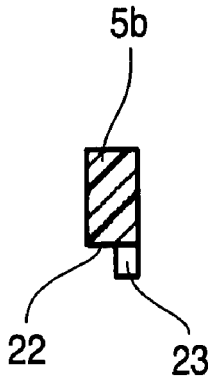

Also as shown by FIGS. 4A and 4B, the link member 5 constituting the lever mechanism is constructed by a constitution of forming a third fitting hole 20 for fitting the third shaft 14 at a base plate 5*a* thereof constituting a triangular shape, forming the connecting hole 21 for engaging the operating claw 17 of the operating handle 2 at a side thereof and in the meantime, extending the front end portion 5*b* in a beak-like shape and bringing a lower face 22 of the front end portion into sliding contact with an upper face of a thick wall portion 28 of a front end of the lever member 7, mentioned later, via a guide piece 23. Further, when the link member 5 is axially supported by the third shaft 14, also the torsional coil spring 6 is mounted simultaneously to urge the front end portion 5*b* to an upper side of the case 1. Therefore, the link member 5 is always going to pivot in the counterclockwise direction and therefore, thereby, the operating handle 2 engaging the operating claw 17 to the connecting hole 21 of the link member 5 is not rattled unpreparedly. Further, a guide pin 24 is for guiding to pivot the link member by being brought into sliding contact with a face thereof opposed to the case 1.

An upper edge of the connecting hole 21 is a linear portion which becomes horizontal at a normal position and is faced on a side of a face thereof opposed to the handle 2. The fillet portion of the operating claw 17 of the operating handle 2 is brought into sliding contact with the faced portion at the upper edge. The third fitting hole 20 is provided at a lower portion of the base plate 5*a*, the connecting hole is provided to be aligned with a substantially horizontal position of the third fitting hole 20 and is disposed on a side opposed to the front end portion 5*b* by interposing the third fitting hole 20. In order to ensure a space of mounting the torsional coil spring 6 between the base plate 5*a* of the link member 5 and the case 1, a connected portion between the base plate 5*a* and the front end portion 5*b* constitutes a crank-like shape folded to bend in a thickness direction and connected to the front end portion 5*b* at an upper portion of the base plate 5*a*.

The guide piece 23 prevents the front end portion 7*b* of the lever member 7 from being deformed and detached from a portion thereof brought into sliding contact with the link member 5 and as mentioned later, also achieves a function of guiding to make an upper face of the thick wall 28 of the lever member 7 smoothly coincide with the lower face of the front end portion 5*b* of the link member 5 when the link member 5 and the lever member 7 are switched from a non sliding contact state to a sliding contact state. The torsional coil spring 6 is caught by the connected portion of the base plate 5*a* and the front end portion 5*b* at one end thereof and caught by the case 1 at other end thereof to urge the link member 5 in the counterclockwise direction. The link member 5 is always urged in the counterclockwise direction by the torsional coil spring 6 and therefore, the operating claw 17 of the operating handle 2 engaged with a hole upper edge of the connecting hole 21 is urged to the lower side of the case 1, a rear face of the operating handle 2 is brought into contact with a surface of the case 1 and therefore, the operating handle 2 is always pressed to the case 1 and is not rattled.

When the fillet portion of the operating claw 17 is brought into sliding contact with the hole upper edge of the connecting hole 21 by pivoting the operating handle 2, the operating claw 17 presses the base plate 5*a* in a direction of being proximate to the case 1, however, the guide pin 24 is brought into sliding contact with an opposed face of the case 1 to maintain an interval between the link member 5 and the case 1 constant and therefore, also an interval between the front end portion 5*b* of the link member 5 and the case 1 can be maintained constant. Therefore, the front end portion 5*b* of the link member 5 is not detached from a portion thereof being brought into sliding contact with the lever member 7, thereby, the guide pin 24 prevents the link member 5 from being detached.

Figure 5A:
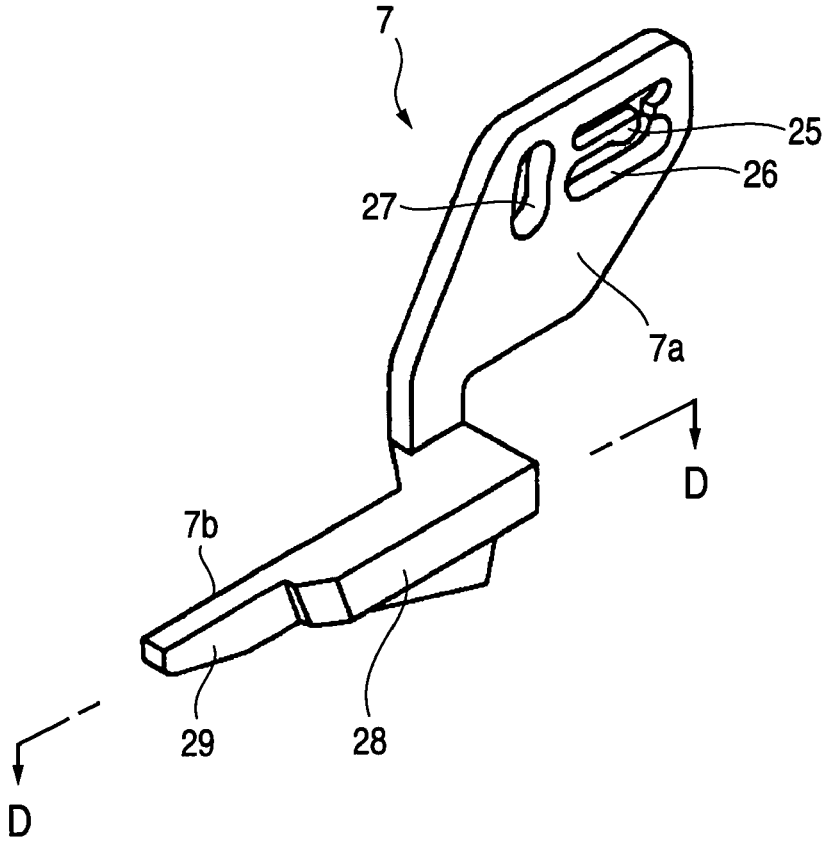
FIG. 5A is a perspective view showing a lever member from a surface side and FIG. 5B is a sectional view taken along a line D-D of FIG. 5A.
Figure 5B:
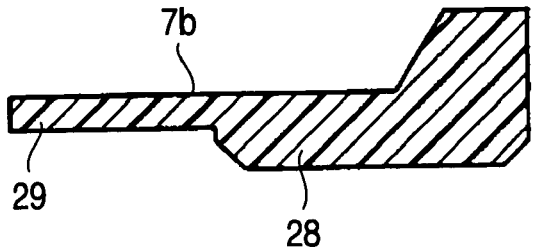

Similarly, also as shown by FIGS. 5A and 5B, the lever member 7 constituting the lever mechanism is constructed by a constitution of forming a first fitting hole 26 in a shape of a long hole having an elastic piece 25 for fitting the first shaft 11 of the case 1 and a second fitting hole 27 in a shape of long hole for fitting the second shaft 12 at a base plate 7*a* thereof constituting a rhombic shape, folding to bend once the front end portion 7*b* from a side of one end portion of the base plate 7*a* in a lateral direction and thereafter extending the front end portion 7*b* in a beak-like shape, continuously forming the thick hole 28 and a thin wall 29 at the front end portion 7*b* and bringing the lower face 22 of the front end portion of the link member 5 into sliding contact with the upper face of the thick wall 28. Therefore, in view of alignment, the front end portion 5*b* of the link member 5, the front end portion 7*b* of the lever member 7 and the engaging portion 19 of the locking member 3 are successively arranged in this order, sliding contact portions of the three members of 5*b*, 7*b* and 19 can be thinned, when the operating handle 2 is operated to pivot, the link member 5 is pivoted in a direction reverse to an urging direction, that is, in the clockwise direction and at the same time, the lever member 7 is pivoted in the counterclockwise direction and the engaging portion 19 of the locking member 3 is moved down against spring pressure of the compression spring 4.

Further, a portion of the lever member 7 connecting the base plate 7*a* and the front end portion 7*b* constitutes a crank-like shape folded to bend in a thickness direction and is connected to the front end portion 7*b* at a lower portion of the base plate 7*a*. In mounting the lever 7 to the case 1, when the connecting portion of the base plate 7*a* and the front end portion 7*b* is disposed between the cylindrical wall 10 and the containing chamber 8 and is arranged at inside of the opening penetrated from the surface side to the rear side of the case 1, by constituting the crank-like shape thereby, the front end portion 7*b* of the lever member 7 is arranged on the surface side of the case 1 and the base plate 7*a* is arranged on the rear side of the case 1. The lever member 7 is connected to the three member sliding contact portion and the second shaft 12 of the case 1 or the eccentric shaft 35 of the key cylinder lock 34, mentioned later, and therefore, when the lever member 7 is arranged on the surface side of the case 1, the bottom face of the recess portion of the cylindrical wall 10 formed with the second shaft 12 or a rear end face of the key cylinder lock 34 provided with the eccentric shaft 35 needs to arrange on the surface side of the case 1. Therefore, by constructing a constitution of connecting the surface side and the rear side of the case 1 by the lever member 7, the key cylinder lock 34 can be arranged to deviate to the rear side without arranging the cylindrical wall 10 and the key cylinder lock 34 to project to the surface side of the case 1 and therefore, a total of the locking apparatus can be thinned.

The first inserting hole 26 is constituted by two long holes extended substantially in a horizontal direction in a normal state and aligned in an up and down direction and a groove connecting the two long holes at vicinities of end portions thereof and the two long holes are formed by different widths to prevent erroneous integration. The width of the long hole on the lower side is constituted by a dimension substantially the same as a diameter of the first shaft 11, the width of the long hole on the upper side is smaller than the dimension and therefore, the first shaft 11 can only be fitted to the long hole on the lower side. The elastic piece 25 surrounded by the two long holes and the groove is constituted by a length providing elastic deformation sufficient for smoothly inserting the first shaft 11 the front end of which constitutes the L-like shape into the long hole on the lower side. A front end of the elastic piece 25 is bulged and the first shaft 11 of the case 1 is fitted to the long hole on the lower side of the first fitting hole 26 and is constrained to the end portion of the long hole by bulging the front end of the elastic piece 25.

When the front end of the first shaft 11 constituting the L-like shape is pressed into the long hole on the lower side of the first fitting hole 26, the shape of the long hole is deformed to receive the front end in the L-like shape by elastic deformation of the elastic piece 25, the first shaft 11 is fitted to the first fitting hole 26 and therefore, the lever member 7 can be prevented from being detached by the front end in the L-like shape of the first shaft 11. After fitting the first shaft 11 to the first fitting hole 26, when the first shaft 11 is made to ride over the bulging of the front end by elastically deforming the elastic piece 25, the first shaft 11 is elastically constrained by the end portion of the long hole on the lower side of the first fitting hole 26 by bulging of the front end of the elastic piece 25 and therefore, the lever member 7 is elastically constrained by the case 1.

The second fitting hole 27 is constituted by a shape of sliding relative to the second shaft 12 of the case 1 to guide the lever member 7 when the lever member 7 is pivoted in a state of elastically constraining the lever member 7 to the case 1, in other words, a shape of a long hole in a bow-like shape centering on the first shaft 11. Further, when the eccentric shaft 35 of the key cylinder lock 34, mentioned later, is fitted to the second fitting hole 27 in place of the second shaft 12, when a key is inserted into the key cylinder lock 34 to rotate, the eccentric shaft 35 provided at a rear end face of the key cylinder 34 is moved to rotate by constituting a center point by a center of rotating the key and therefore, the lever member 7 can be moved in a transverse direction and when the lever member is moved in the transverse direction, the first shaft 11 fitted to the long hole of the first fitting hole 26 is moved to other end side of the long hole by riding over the bulging of the front end by elastically deforming the elastic piece 25 brought into contact therewith. Thereafter, the first shaft 11 does not return to an original position owing to the bulging of the front end of the elastic piece 25 so far as the eccentric shaft 35 is not forcibly returned by rotating the key.

Therefore, in the case of integrating the locking apparatus having such a constitution, first, with regard to the surface side of the case 1, the third fitting hole 20 formed at the base plate 5*a* of the link member 5 is fitted with the third shaft 14, at this occasion, simultaneously, one end of the torsional coil spring 6 is caught by the connecting portion of the base plate 5*a* and the front end portion 5*b* of the link member 5, other end thereof is caught by a side of the case 1, thereafter, a push on fix 30 is attached to lock a front end of the third shaft 14, thereby, the link member 5 is not drawn out and is pivotably supported axially by the side of the case 1 in a state of urging the front end portion 5*b* in the counterclockwise direction by the spring pressure of the torsional coil spring 6. Further, the push on fix 30 is made of a metal and is constituted by a structure of forming an inserting hole for inserting the third shaft 14 at a central portion of a ring member and forming to raise a plurality of biting claws biting a side face of the third shaft 14 at a hole edge of the inserting hole.

Hence, at this occasion, when the compression coil spring 4 and the locking member 3 are inserted into the containing chamber 8 of the case 1 while making the guide groove on the side of the containing chamber 8 and the projection on the side of the locking member 3 coincide with each other, the locking member 3 is urged to the upper side of the case 1 by the spring pressure of the compression coil spring 4, the engaging portion is made to face outside from the opening port 15 of the containing chamber 8 and therefore, after achieving such a state, the front end portion 7*b* of the lever member 7 constituting the crank-like shape is guided to the surface side of the case 1 by utilizing the opening disposed between the cylindrical wall 10 and the containing chamber 8 of the case 1 and penetrated from the surface side to the rear side of the case 1, the front end portion 7*b* is brought into sliding contact with the engaging portion 19 of the locking member 3 from the upper side while pressing down the locking member 8, in the meantime, the first shaft 11 is fitted to the first fitting hole 26 while fitting the second shaft 12 to the second fitting hole 27 formed at the base plate 7*a* arranged on the rear side of the case 1, then, the elastic piece 25 is elastically deformed and the first shaft 11 is smoothly fitted to the first fitting hole 26 and therefore, thereby, also the lever member 7 is not drawn out but pivotably supported axially by the side of the case 1. Further, by axially supporting the lever member 7, the front end portion 5*b* of the link member 5 is brought into sliding contact with the front end portion 7*b* of the lever member 7 which is brought into contact with the engaging portion 19 of the locking member 3 from the upper side to thereby constitute the three members sliding contact portion.

Figure 6A:
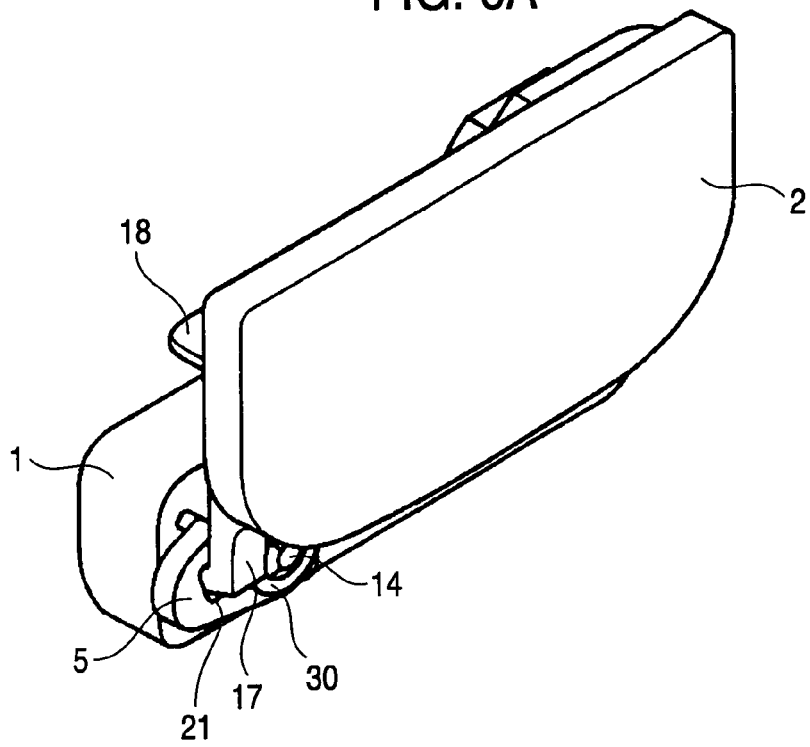
FIG. 6A is a perspective view showing an integrated locking apparatus from a surface side and FIG. 6B is a perspective view showing the locking apparatus from the rear side.
Figure 6B:
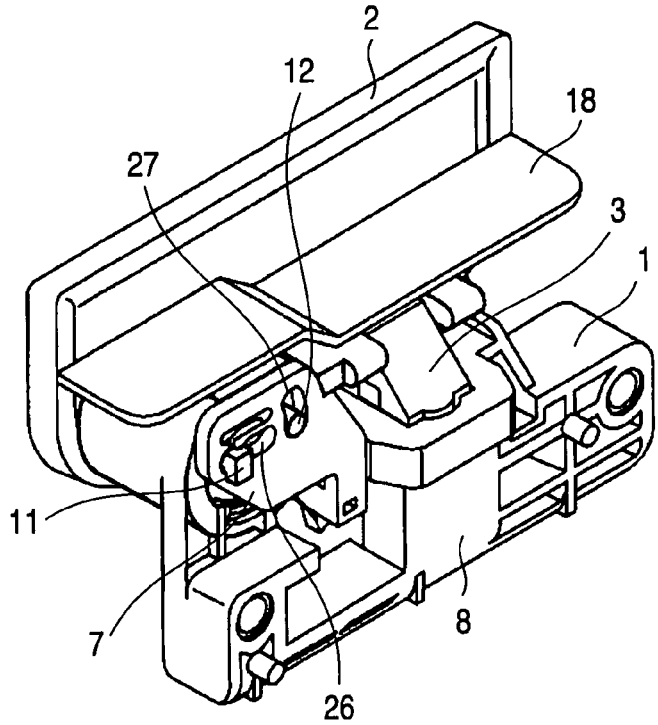
Figure 7:
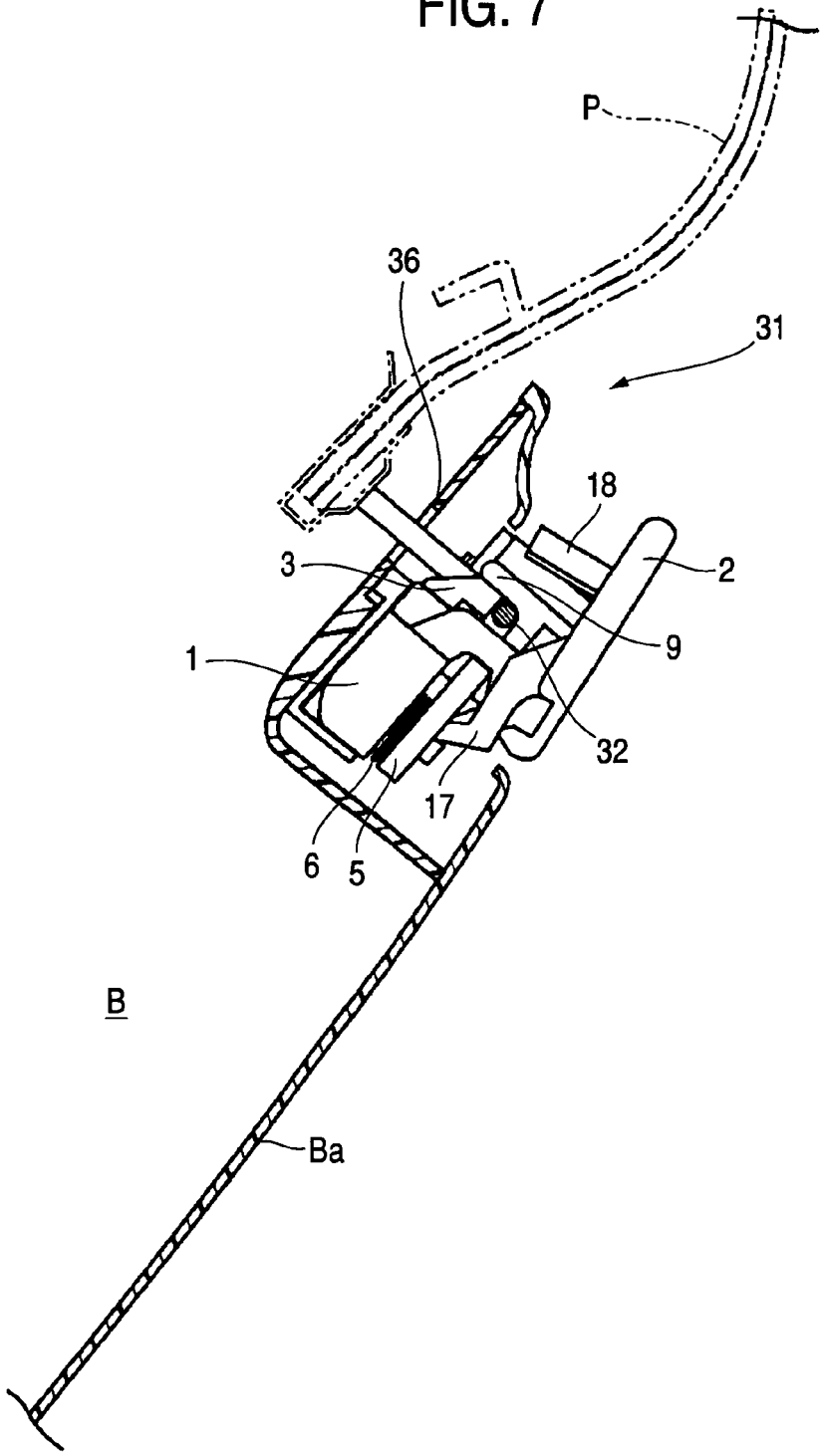
FIG. 7 is an explanatory view showing a state of screwing the locking apparatus to an upper end edge of a glove door.

Next, finally, when the shaft portions 13 on the side of the case 1 and the bearing portions 16 on the side of the operating handle 2 are fitted to each other by pressing the operating handle 2 to the surface side of the case 1 while engaging the operating claw 17 of the operating handle 2 to the connecting hole 21 of the link member 5, thereby, the operating handle 2 is pivotably supported axially by the case 1 and as shown by FIGS. 6A and 6B, the locking apparatus can simply be integrated. Therefore, thereafter, when the case 1 is screwed to a central portion of an upper end edge of the glove door B1, thereby, as shown by FIG. 7, the locking apparatus is provided for practical use. Further, in this case, as shown by FIG. 7 and FIG. 13, the glove box B is provided with a recess portion having a depth for making the design face of the operating handle 2 of the locking apparatus and the design face of the glove door Ba present substantially on the same plane and a bottom face of the recess portion is arranged with an inserting port 36 through which the striker 32 can pass. Since the design face of the operating handle 2 and the design face of the glove door Ba are arranged substantially on the same plane, presence of the locking apparatus per se does not constitute a projection or a recess at inside of the vehicle.

Further, in this case, the operating space 31 for inserting the finger is present on the side of the instrument panel P in correspondence with the operating handle 2, the locking apparatus per se is only fixed to the side of the glove door Ba and therefore, a portion unnecessarily projected to the inner side of the glove box B as in the prior art is dispensed with and therefore, a concern of constituting a hindrance in putting in and out small articles is eliminated and the inner space of the glove box B can effectively be utilized.

Figure 8:
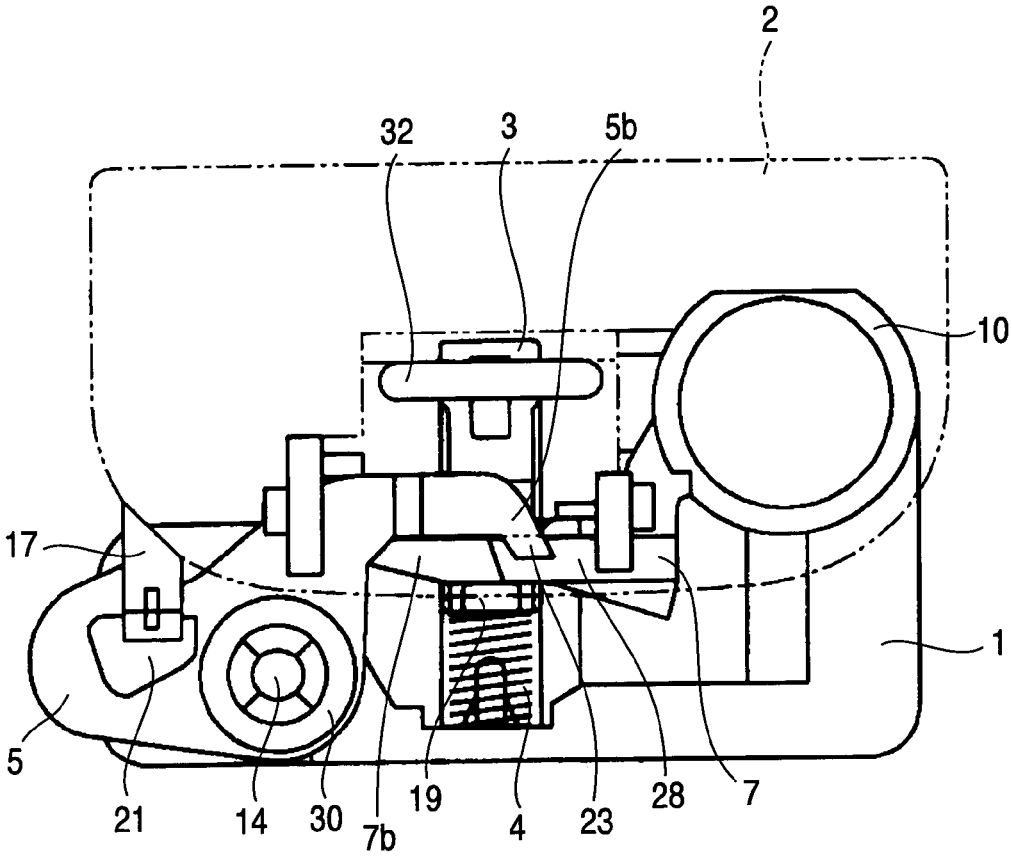
FIG. 8 is a partially cut explanatory view showing a lock state of a glove box.

Further, in actual use, when the glove box B is constrained at a locking position, as shown by FIG. 8, the locking member 3 is engaged with the striker 32 between the front end portion of the locking member 3 and the receiving wall 9 by the spring pressure of the compression coil spring 4 at inside of the containing chamber 8 and the glove box B is prevented from moving in an opening direction, on the other hand, the front end portion 5*b* of the link member 5 is urged to the upper side of the case 1 by the torsional coil spring 6, also the front end portion 7*b* of the lever member 7 is urged to the upper side of the case 1 by the spring pressure of the compression coil spring 4 while being brought into contact with the engaging portion 19 of the locking member 3 and therefore, under the state, the respective members 5 and 7 are not operated to unlock at all. Further, under the state, the operating claw 17 of the operating handle 2 is engaged with the connecting hole 21 of the link member 5 urged in the counterclockwise direction and therefore, there is not a concern of rattling the operating handle 2 unpreparedly. Further, the glove door Ba screwed with the case 1 is locked by the instrument panel P by constituting a surrounded space by cooperating the locking member 3 urged by the compression coil spring 4 and the case 1 and constraining the striker 32 provided on the side of the instrument panel P via the inserting hole 36 at inside of the space.

Figure 9:
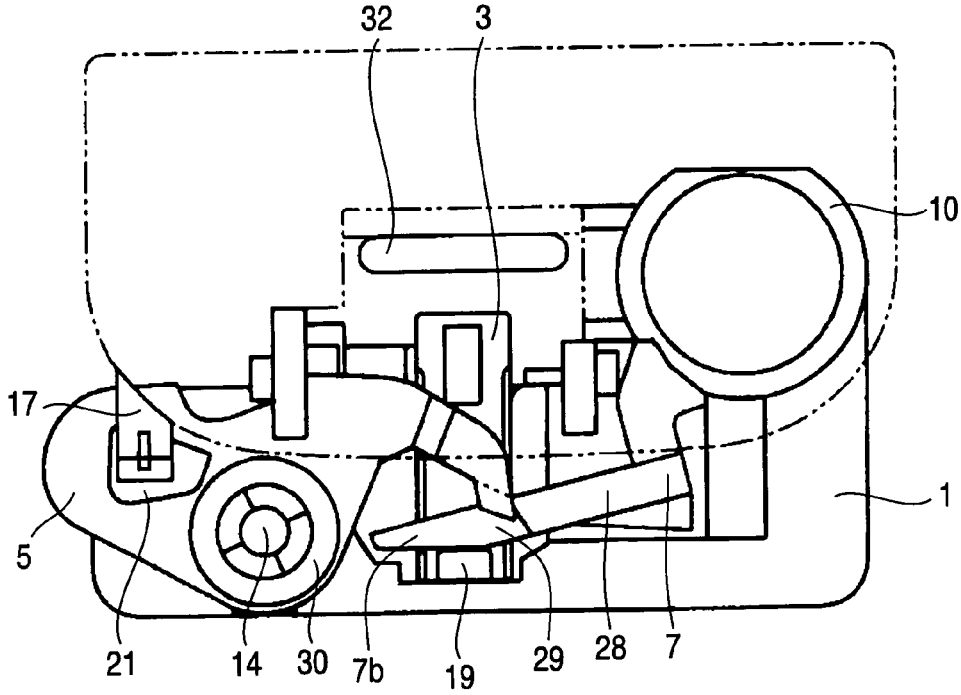
FIG. 9 is a partially cut explanatory view showing an unlock state of the glove box.

Conversely, in the case of releasing the glove box B from being constrained at the locking portion, when the operating handle 2 is operated to pivot from an upper side to a lower side by inserting the finger into the operating space 31 partitioned on the side of the instrument panel P, as shown by FIG. 9, in accordance therewith, by operating the operating claw 17 engaged with the connecting hole 21 on the side of the operating handle 2, the link member 5 is pivoted in the clockwise direction reverse to the urging direction, the front end portion 7*b* of the lever member 7 is pressed to the lower side of the case 1 by the front end portion 5*b* against the spring pressure of the compression coil spring 4 and therefore, in cooperation therewith, the front end portion 7*b* of the lever member 7 presses the engaging portion 19 of the locking member 3 to thereby move down the locking member 3 at inside of the containing chamber 8 of the case 1. Therefore, thereby, the locking member 3 is released from being engaged with the striker 32 and therefore, the glove box B is permitted to move to an unlocked position.

Further, when the operating handle 2 is pivoted from the instrument panel P to the side of the glove box B, the pivoting force is transmitted to the locking member 3 via the three members sliding contact portion to thereby move down the locking member 3, thereby, an opening capable of passing the striker 32 is produced at the space surrounded by the locking member 3 and the case 1 and therefore, the glove door Ba screwed with the case 1 is made to be pivotable to unlock. When the glove door B is pivoted in an opening direction under the state, the glove box B is brought into an opened state and small articles can be put to and from the glove box B.

In the glove box B in an open state, when the glove door Ba is pivoted in the closing direction, the striker 32 is brought into contact with the inclined face 3*a* of the locking member 3 by passing the inserting port 36 and when the glove door Ba is further pivoted, a component of force is produced in a direction of sliding the locking member 3 by pressing the inclined face 3*a* of the locking member 3 by the striker 32, the locking member 3 is pressed down by the component of force, and the opening is produced in the space surrounded by the locking member 3 and the case 1. The striker 32 is made to advance into the space by passing the opening, the glove door Ba is pivoted to bring the glove box B into the closed state, the striker 32 and the locking member 3 are released from being brought into contact with each other and therefore, the locking member 3 is pressed up by the compression coil spring 4, the locking member 3 and the case 1 form the closed space in a state of surrounding the striker 32 and therefore, thereby, the glove door Ba is constrained to lock again to the side of the instrument panel lP.

Further, when the operating handle 2 is operated, the safety plate 18 is formed on the rear face of the operating handle 2 and therefore, there is not a concern of being injured by a part arranged on the rear face side of the operating handle 2, the part can be concealed by the safety plate 18 and therefore, outlook thereof is also promoted. Further, according to the embodiment, in view of a relationship of engaging the operating claw 17 formed on an outer side of a fulcrum of pivoting the operating handle 2 to the connecting hole 21 formed on an outer side of a fulcrum of pivoting the link member 5, an angle of operating the operating handle 2 becomes obtuse, an amount of moving the locking member 3 is reduced, a distance between the operating lever 17 and the locking member 3 can be increased and therefore, also the operating force is reduced.

Further, the torsional coil spring 6 may be a compression spring installed between a lower face of the front end portion 5*b* of the link member 5 and the case 1, or a tension coil spring installed between an end portion of the base plate 5*a* of the link member 5 and an upper portion of the case 1, although not illustrated, and therefore, according to the embodiment, the compression coil spring 4 is referred to as a first urging member and the torsional coil spring 6 is referred to as a second urging member. Further, the locking apparatus according to the embodiment is not limited to dispose at the upper end edge of the glove door Ba so far as the locking apparatus is provided at an end edge of the glove door Ba but the locking apparatus may be provided at a side end edge or a lower end edge of the glove door Ba. Further, not only the locking member 3 is constrained by the striker 32 provided at the instrument panel P to bring the glove door Ba into a locked state but also a counterpart constrained thereby may be a hole provided at the instrument panel P or a portion of the instrument panel P. Further, in the locking apparatus according to the embodiment, the cylindrical wall 10 and the third shaft 14 of the case 1 may be arranged on either side of the sliding shaft of the locking member 3 and therefore, when the cylindrical wall 10 and the third shaft 14 are disposed to be opposed to the above-described arranging positions, the link member 5 is always urged in the clockwise direction by the torsional coil spring 6. Therefore, the front end portion 7*b* of the link member 5 may be said to be urged to a side urged always.

Further, although the above-described embodiment is applied to the locking apparatus which is not provided with the key cylinder lock, the invention is not limited thereto but can serve also as a locking apparatus having a key cylinder. In this case, the key cylinder lock 34 is selecting means for selecting a position at which the link member 5 and the lever member 7 are brought into a sliding contact state and a position at which the both members 5 and 7 are brought into a nonsliding contact state, by rotating the key inserted into the key cylinder lock 34, as described above, the lever member 7 is moved in the horizontal direction up to a position shown by a bold line of FIGS. 12A and 12B and therefore, an upper face of the front end portion 7*b* of the lever member 7 and a lower face of the front end portion 5*b* of the link member 5 are separated to be remote from each other to bring about the nonsliding contact state. When the operating handle 2 is pivoted from the side of the instrument panel P to the side of the glove box under the state, the pivoting force only pivots the link member 5 and does not pivot the lever member 7 and therefore, also the locking member 3 stays to be unmoved. A so-to-speak locked state is brought about, the glove B cannot be brought into the opened state and therefore, small articles at inside of the glove box B can be protected against robbery or the like.

Figure 12A:
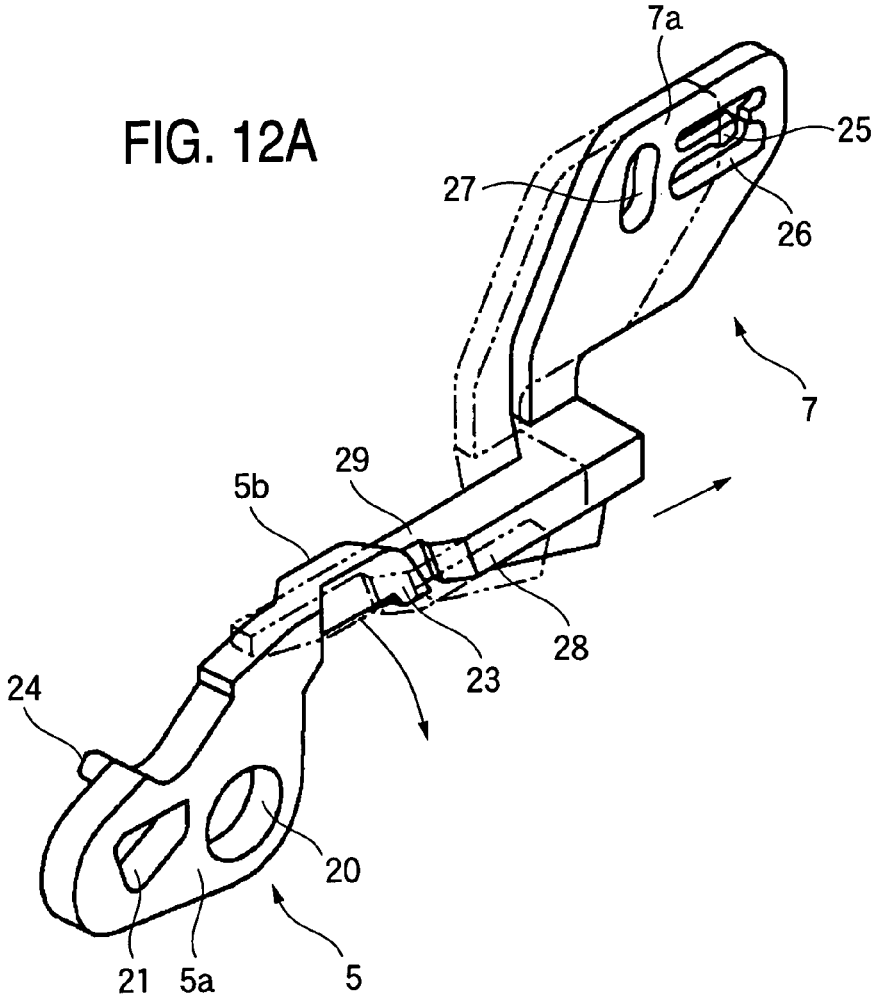
FIG. 12A is a perspective view of an essential portion showing a state in which a lower face of a front end portion of a link member is separated from an upper face of a thick wall of a lever member and FIG. 12B is a plane view thereof.
Figure 12B:
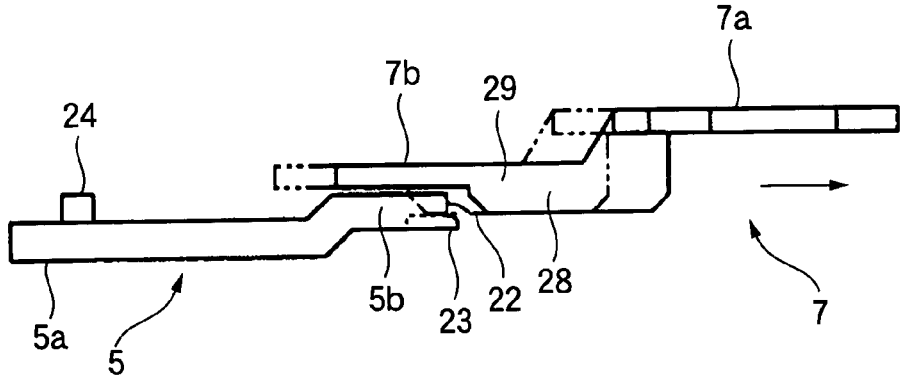

By inserting the key again into the key cylinder 34 to rotate in the reverse direction, the lever member 7 is moved up to a position designated by a two-dotted chain line of FIGS. 12A and 12B and therefore, the upper face of the front end portion 7*b* and the lower face of the front end portion 5*a* are brought into the sliding contact state. When the operating handle 2 is pivoted from the side of the instrument panel P to the side of the glove box B under the state, as described above, the pivoting force pivots the link member 5 and the lever member 7 to move down the locking member 3 to release the locked state and therefore, the glove box B can be brought into the open state. Therefore, since the link member 5 and the lever member 7 can be switched from the nonsliding contact state to the sliding contact state by the key cylinder 34 and therefore, the unlocked state can be recovered.

Figure 10:
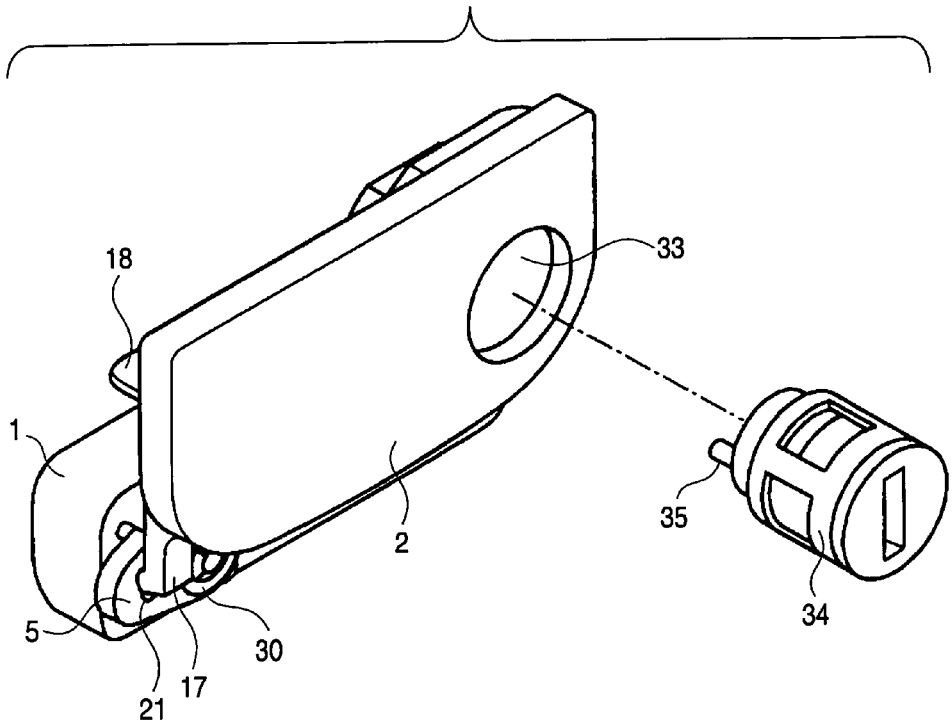
FIG. 10 is a perspective view of an essential portion showing a state of being applied to a locking apparatus having a key cylinder from a surface side.
Figure 11:
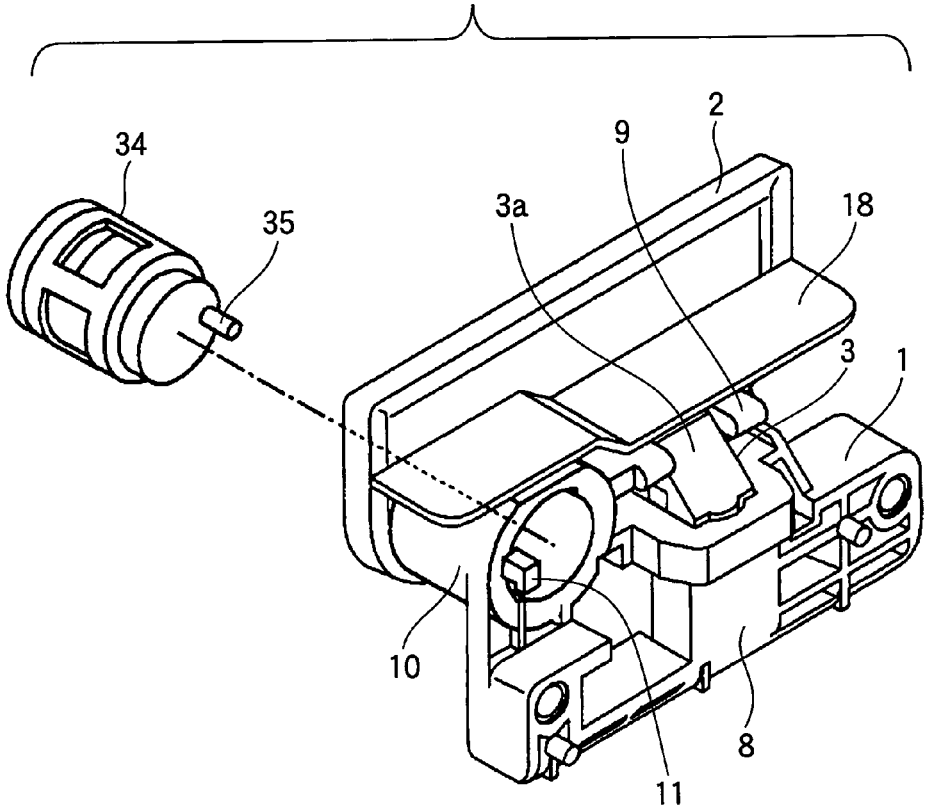
FIG. 11 is a perspective view of an essential portion showing the state of being applied to the locking apparatus having the key cylinder from a rear side.

That is, specifically, as shown by FIG. 10 and FIG. 11, when there is constructed a constitution in which whereas an opening 33 communicating with the cylindrical wall 10 is formed, the bottom face of the cylindrical wall 10 is removed along with the second shaft 12, the key cylinder lock 34 is mounted into the cylindrical wall 10 from the opening 33 and the eccentric shaft 35 provided at the rear end face of the key cylinder 34 is utilized as the second shaft 12, immediately, the locking apparatus serves also as the locking apparatus having the key cylinder 34. Further, at this occasion, in view of a relationship of connecting the eccentric shaft of the key cylinder 34 between the pivoting fulcrum and an operating plate of the lever member 7, the eccentric shaft 35 of the key cylinder 34 serves also as a guide in pivoting the lever member 7 and therefore, smooth operation can be guaranteed.

Also in this case, locking and unlocking of the glove box B are basically the same as those of the locking apparatus which is not provided with the key cylinder 34, a difference therebetween is that in view of a relationship of utilizing the eccentric shaft 35 of the key cylinder 34 as the second shaft 12, when the eccentric shaft 35 is inserted into the second inserting hole 27 of the lever member 7 and the key cylinder 34 is locked, the eccentric shaft 35 is rotated to slide in the horizontal direction of the case 1 while pivoting the lever member 7 and therefore, thereby, as shown by FIGS. 12A and 12B, the lower face 22 of the front end portion of the link member 5 is separated from the upper face of the thick wall 27 of the lever member 7 to be switched to the nonsliding contact state and therefore, even when the handle 2 is erroneously operated to pivot under the state, the pivoting force of the link member 5 is not transmitted to the lever member 7 and therefore, the operating handle 2 is idly moved and unlocking cannot be carried out.

Further, in this case, by constructing the constitution of arranging the lever member 7 from the surface side to the rear side of the case 1, the cylindrical wall 10 and the key cylinder 34 can be arranged to deviate to the rear side of the case 1 and therefore, a total of the locking apparatus can be thinned.

Although the present invention has been shown and described with reference to a specific preferred embodiment, various changes and modifications will be apparent to those skilled in the art from the teachings herein. For example, the present invention can be applied to operculiform door which is opened and closed to the box that is fixed on a vehicle body. Such changes and modifications as are obvious are deemed to come within the spirit, scope and contemplation of the invention as defined in the appended claims.

As described above, according to the invention, by adopting the above-described constitution, in view of the relationship of axially supporting the operating handle pivoted from the upper side to the lower side by the upper end edge of the storage and partitioning the operating space for inserting the finger in correspondence with the operating handle of the supporting member, the portion which is unnecessarily projected to the inner side of the storage as in the prior art is dispensed with and therefore, there is not a concern of constituting a hindrance in putting in and out small articles and the inner space of the storage can effectively be utilized.

What is claimed is:

1. A locking apparatus for a glove box provided in front of a passenger seat of a vehicle, the locking apparatus comprising:

the glove box;

a case attached to an end edge of a door of the glove box;

a locking member slidably supported by the case for engaging with and disengaging from a supporting member;

a first urging member that urges the locking member in a direction of the supporting member;

an operating handle for unlocking the door of the glove box;

a lever mechanism for sliding the locking member against the first urging member by pivoting the operating handle, said lever mechanism including a link member; and an operating space disposed between the supporting member and the operating handle, the operating handle including an operating claw, wherein:

the operating handle is pivotably supported by the case at a portion that is distal to the end edge of the door of the glove box, the operating handle is pivoted from a side of the supporting member to a side of the door of the glove box at a portion that is proximal to the end edge of the door of the glove box, when the door of the glove box is unlocked; and the operating space is formed by hollowing a portion of the supporting member which corresponds to the operating handle; and wherein when the operating handle is pulled, the locking apparatus is unlocked by moving the operating claw toward an upper side of the glove box, the link member changes a direction of moving, and the locking member disengages from a striker.

2. The locking apparatus according to claim 1, wherein:

the lever mechanism further includes a lever member; and the link member and the lever member are pivotably supported axially by the case and capable of switching the link member and the lever member between a sliding contact state and a nonsliding contact state.

3. The locking apparatus according to claim 2, further comprising:

a second urging member for urging a front end portion of the link member to a side of the locking member.

4. The locking apparatus according to claim 2, further comprising:

an engaging portion brought into sliding contact with the lever member; and a three members sliding contact portion including the front end portion of the link member and the engaging portion to be brought into sliding contact therewith, wherein the locking member includes the engaging portion.

5. The locking apparatus according to claim 4, further comprising a key cylinder lock having an eccentric shaft for switching the sliding contact state and the nonsliding contact state, wherein the lever member is connected to the eccentric shaft between an axially supported position thereof and the three members sliding contact portion.

6. The locking apparatus according to claim 4, wherein:

the operating handle includes the operating claw between a pivot position of the operating handle and a side portion of the operating handle; and the link member includes a connecting hole for engaging with the operating claw on a side opposed to the three members sliding contact portion.

7. The locking apparatus according to claim 2, wherein:

the lever member comprises a front edge portion, the locking member comprises an engaging portion that contacts the front edge portion of the lever member, and the link member comprises a front end portion for cooperation with the first urging member.

8. The locking apparatus according to claim 7, wherein the front edge portion of the lever member, the engaging portion of the locking member and the front end portion of the link member comprise a three members sliding contact portion.

9. The locking apparatus according to claim 1, wherein the glove box includes an upper side and a lower side, and the upper side swings around the lower side to open the glove box.

10. The locking apparatus according to claim 9, wherein an instrument panel of the vehicle comprises a concave portion having a smooth surface, and the striker is disposed in the concave portion corresponding to the upper side of the glove box.

11. The locking apparatus according to claim 10, wherein:

the locking apparatus is disposed on the upper side of the glove box corresponding to the concave portion, the operating handle of the locking apparatus is pivotably supported by a lower portion of the operating handle, and an upper side of the operating handle is pulled to unlock the locking apparatus.

12. A locking apparatus for locking a door of a vehicle glove box, the locking apparatus comprising:

the glove box;

a case attached to an edge of the door of the vehicle glove box;

a locking member slidably supported by the case;

a first urging member that urges the locking member in a first direction;

an operating handle pivotally mounted to the case for releasing the door of the vehicle glove box from a closed position, the operating handle including an operating claw, and a lever mechanism movably mounted to the case that slides the locking member against the first urging member by pivoting the operating handle, the lever mechanism including a link member, wherein when the operating handle is pulled, the locking apparatus is unlocked by moving the operating claw toward an upper side of the glove box, the link member changes a direction of moving, and the locking member disengages from a striker.

13. The locking apparatus according to claim 12, wherein the case comprises a pair of shaft portions that project from a first side face of the case.

14. The locking apparatus according to claim 13, wherein the operating handle comprises a pair of bearing portions that project from the operating handle, the pair of bearing portions pivotally engaged with the pair of shaft portions.

15. The locking apparatus according to claim 12, wherein:

the lever mechanism comprises a lever member and the link member, and the case comprises a fixed shaft that projects from a second side face of the case.

16. The locking apparatus according to claim 15, wherein the lever member is pivotally mounted to the case by the fixed shaft.

17. The locking apparatus according to claim 15, wherein the case further comprises a fulcrum shaft that projects from a first side face of the case.

18. The locking apparatus according to claim 17, wherein said link member is pivotally mounted to the case by the fulcrum shaft.

19. The locking apparatus according to claim 15, wherein the operating claw projects from the operating handle and operably engages with the link member.

* * * * *